US010081532B2

(12) United States Patent
Gray et al.

(10) Patent No.: US 10,081,532 B2
(45) Date of Patent: Sep. 25, 2018

(54) DISPENSING NOZZLE WITH MAGNETIC ASSIST

(71) Applicants: John M. Gray, Cincinnati, OH (US); Timothy M. Garrison, Cincinnati, OH (US); Matthew R. Lauber, Loveland, OH (US)

(72) Inventors: John M. Gray, Cincinnati, OH (US); Timothy M. Garrison, Cincinnati, OH (US); Matthew R. Lauber, Loveland, OH (US)

(73) Assignee: OPW FUELING COMPONENTS, LLC, Hamilton, OH (US)

( * ) Notice: Subject to any disclaimer, the term of this patent is extended or adjusted under 35 U.S.C. 154(b) by 55 days.

(21) Appl. No.: 15/048,394

(22) Filed: Feb. 19, 2016

(65) Prior Publication Data

US 2017/0240416 A1 Aug. 24, 2017

(51) Int. Cl.

| | |
|---|---|
| ***B67D 7/42*** | (2010.01) |
| ***B67D 7/04*** | (2010.01) |
| *B67D 7/36* | (2010.01) |

(52) U.S. Cl.

CPC ..... *B67D 7/42* (2013.01); *B67D 7/04* (2013.01); *B67D 7/36* (2013.01)

(58) Field of Classification Search

CPC ..... B67D 7/04; B67D 7/36; B67D 7/42
USPC ..... 141/206, 208, 218, 219, 392
See application file for complete search history.

(56) References Cited

U.S. PATENT DOCUMENTS

| | | | | | |
|---|---|---|---|---|---|
| 2,758,768 | A | * | 8/1956 | Payne | B67D 7/48 137/454.5 |
| 2,981,229 | A | | 4/1961 | Henry | |
| 3,005,476 | A | | 10/1961 | Klaus | |
| 3,085,600 | A | | 4/1963 | Briede | |
| 3,205,922 | A | | 9/1965 | Davis et al. | |
| 3,323,560 | A | * | 6/1967 | Ehlers | B67D 7/48 137/533.13 |
| 3,521,680 | A | | 7/1970 | Wood et al. | |
| 3,603,359 | A | | 9/1971 | Belue | |
| 3,653,415 | A | | 4/1972 | Boudot et al. | |
| 3,817,285 | A | | 6/1974 | Wilder et al. | |
| 4,265,281 | A | | 5/1981 | Oberrecht | |
| 5,067,533 | A | | 11/1991 | Carder, Sr. et al. | |
| 5,309,957 | A | * | 5/1994 | Saisuu | B67D 7/342 141/196 |
| 5,417,259 | A | * | 5/1995 | Schneider | B67D 7/048 141/206 |
| 5,469,900 | A | | 11/1995 | Weeks et al. | |
| 5,474,115 | A | * | 12/1995 | Fink, Jr. | B67D 7/34 141/206 |
| 5,575,309 | A | | 11/1996 | Connell | |

(Continued)

*Primary Examiner* — Timothy L Maust
(74) *Attorney, Agent, or Firm* — Thompson Hine LLP

(57) ABSTRACT

A nozzle system including a nozzle body having a fluid path through which fluid to be dispensed is flowable. The system includes a fluid valve positioned in the fluid path and movable between a first position and a second position, and a manually operable lever operatively coupleable to the fluid valve and movable between a first position and a second position. The system further has a biasing mechanism configured to apply a force biasing at least one of the valve or the lever to one of the associated first or second positions, and a magnetic assist system configured to apply a magnetic force opposing the biasing force applied by the biasing mechanism.

12 Claims, 6 Drawing Sheets

(56) References Cited

U.S. PATENT DOCUMENTS

| | | | | |
|---|---|---|---|---|
| 6,003,734 | A * | 12/1999 | Oh | B67D 3/0003 141/351 |
| 6,398,084 | B2 * | 6/2002 | Maruyama | B67D 1/1234 141/192 |
| 6,532,919 | B2 | 3/2003 | Curtis et al. | |
| 6,698,471 | B1 | 3/2004 | Carmack | |
| 7,255,140 | B2 | 8/2007 | Poli | |
| 8,286,677 | B2 | 11/2012 | Grantham | |
| 8,347,924 | B2 * | 1/2013 | Meyer | B67D 7/04 141/206 |
| 8,371,341 | B2 | 2/2013 | Gray | |
| 8,434,531 | B2 | 5/2013 | Grantham | |
| 8,499,802 | B2 | 8/2013 | Falckenberg et al. | |
| 8,539,991 | B1 * | 9/2013 | Carmack | B67D 7/48 141/206 |
| 8,752,597 | B2 * | 6/2014 | Tumarkin | B67D 7/42 141/206 |
| 2003/0196721 | A1 * | 10/2003 | Graffin | B67C 3/26 141/302 |
| 2011/0061764 | A1 * | 3/2011 | Springer | A47G 19/2205 141/1 |
| 2011/0220244 | A1 * | 9/2011 | Varini | B67D 7/425 141/392 |
| 2014/0311579 | A1 | 10/2014 | Nanaji | |

* cited by examiner

DISPENSING NOZZLE WITH MAGNETIC ASSIST

The present invention is directed to a dispensing device, such as a fluid dispensing nozzle, with a magnetic assist feature or system.

BACKGROUND

Fluid dispensing systems, such as gasoline refueling stations and the like, typically include a dispenser with manually operable nozzle for dispensing the fluid. In many cases the nozzle includes a lever that is manually raised to operate the nozzle. Nozzles may also include a hold-open latch or device that retains the lever in the raised position so that the user does not have to manually retain the lever in its raised position during the entire dispensing operation. However, a hold-open device may not be desired to be used with certain nozzles, such as "A-cap" style nozzles (e.g. a nozzle that does not utilize a no-pressure no-flow valve), due to the potential of a subsequent user of the nozzle undesirably dispensing fuel when the nozzle remains latched open by the previous user. In addition, many existing hold-open devices are not sufficiently easy to use, robust, or durable.

If a hold-open device is not utilized, the user may be required to manually hold open the nozzle during dispensing, which can last between about 2-4 minutes or more which can lead to fatigue. Moreover, due to the spring arrangement in many existing nozzles, the user may be required to apply a maximum force to the spring in order to maximize the fluid dispensing rate, leading to increased fatigue.

SUMMARY

In one embodiment, the present invention is a dispensing nozzle with a magnetic assist feature or system which reduces the force required by a user to maintain the nozzle in its dispensing configuration. More particularly, in one embodiment the invention is a nozzle system including a nozzle body having a fluid path through which fluid to be dispensed is flowable. The system includes a fluid valve positioned in the fluid path and movable between a first position and a second position, and a manually operable lever operatively coupleable to the fluid valve and movable between a first position and a second position. The system further has a biasing mechanism configured to apply a force biasing at least one of the valve or the lever to one of the associated first or second positions, and a magnetic assist system configured to apply a magnetic force opposing the biasing force applied by the biasing mechanism.

DETAILED DESCRIPTION

Figure 1:
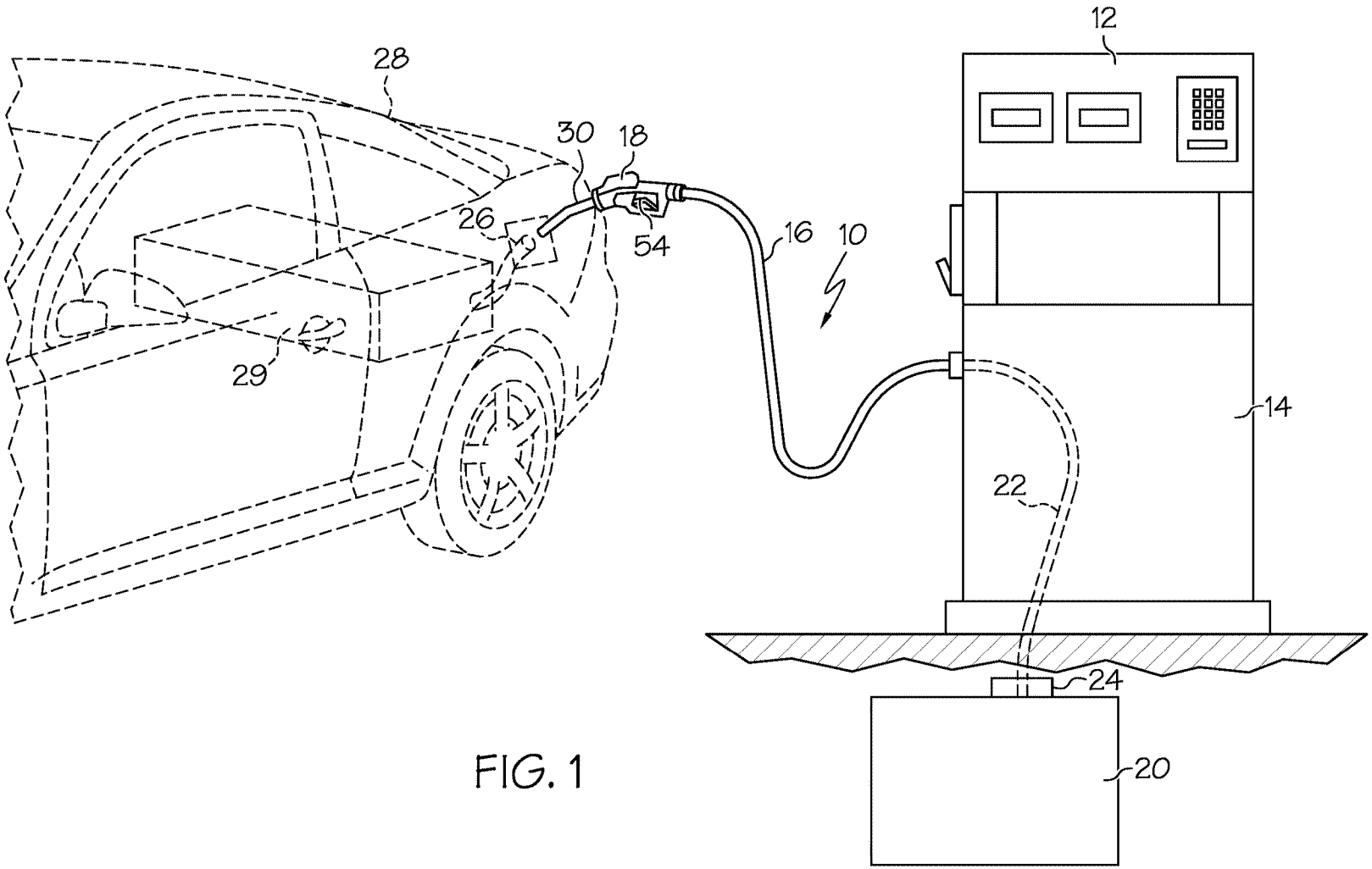
FIG. 1 is a schematic representation of a refueling system.

FIG. 1 is a schematic representation of a refilling system 10 including a dispenser 12. The dispenser 12 includes a dispenser body 14, a hose 16 coupled to the dispenser body 14, and a nozzle 18 positioned at the distal end of the hose 16. The hose 16 may be generally flexible and pliable to allow the hose 16 and nozzle 18 to be positioned in a convenient refilling position as desired by the user/operator.

The dispenser 12 is in fluid communication with a fuel/fluid storage tank 20 via a liquid or fluid conduit or path 22 that defines a fluid path/flow path therein, and extends from the dispenser 12 to the storage tank 20. The storage tank 20 can include or be fluidly coupled to a pump 24 which is configured to draw fluid/fuel out of the storage tank 20 and supply the fluid to the dispenser 12/nozzle 18. The nozzle 18 can be inserted into a fill pipe 26 of a vehicle 28 and operated to fill/refuel a fuel tank 29 of the vehicle 28, or to fill some other fuel/fluid containment vessel.

The nozzle 18/dispenser 12 can also be configured to capture and route vapors being expelled from the storage tank 20 during refueling via a vapor recovery system (not shown). In that case the nozzle 18 and hose 16 can each include a vapor recovery path (not shown) that is fluidly isolated from the fluid dispensing path. The system 10 and nozzle 18 can be utilized to store/dispense any of a wide variety of fluids, liquids or fuels, including but not limited to petroleum-based fuels, such as gasoline, diesel, natural gas, biofuels, blended fuels, propane, oil, ethanol, compressed natural gas ("CNG"), liquefied petroleum gas ("LPG"), oil, and the like.

With reference to FIGS. 2, 3, 5 and 6, the nozzle 18 can include a nozzle body 30 having a fluid path 32 through which fluid to be dispensed is flowable. A fluid valve, such as a poppet valve or main poppet valve 34, is positioned in the fluid path 32. The illustrated fluid valve 34 includes a movable portion 36 which includes a body 38, an upper portion 40, a sealing flange 42 positioned between the body 38 and the upper portion 40, and a vertically oriented stem 44. The stem 44 of the valve 34 extends through various seals and the like and such that a lower end 46 of the stem 44 protrudes outwardly from the nozzle body 30 in a sealed manner. The movable portion 36 of the valve 34, and in particular the sealing flange 42, is configured to sealingly engage a valve seat 48 which can be positioned on and/or form part of the nozzle body 30.

The fluid valve 34/movable portion 36 is movable between a first, lower, non-operating or closed position (FIGS. 2 and 5) in which the movable portion 36/flange 42 sealingly engages the seat 48 to block the flow of fluid through the valve 34/fluid path 32, and a second, upper, operating or open position (FIGS. 3 and 6) in which the movable portion 36/flange 42 is spaced away from the seat 48 to enable fluid to flow through the valve 34/fluid path 32. The valve 34/movable portion 36 can thus have a range of motion defined by the first position at one end of the range of motion and the second position at the other end of the range of motion.

Figure 3:
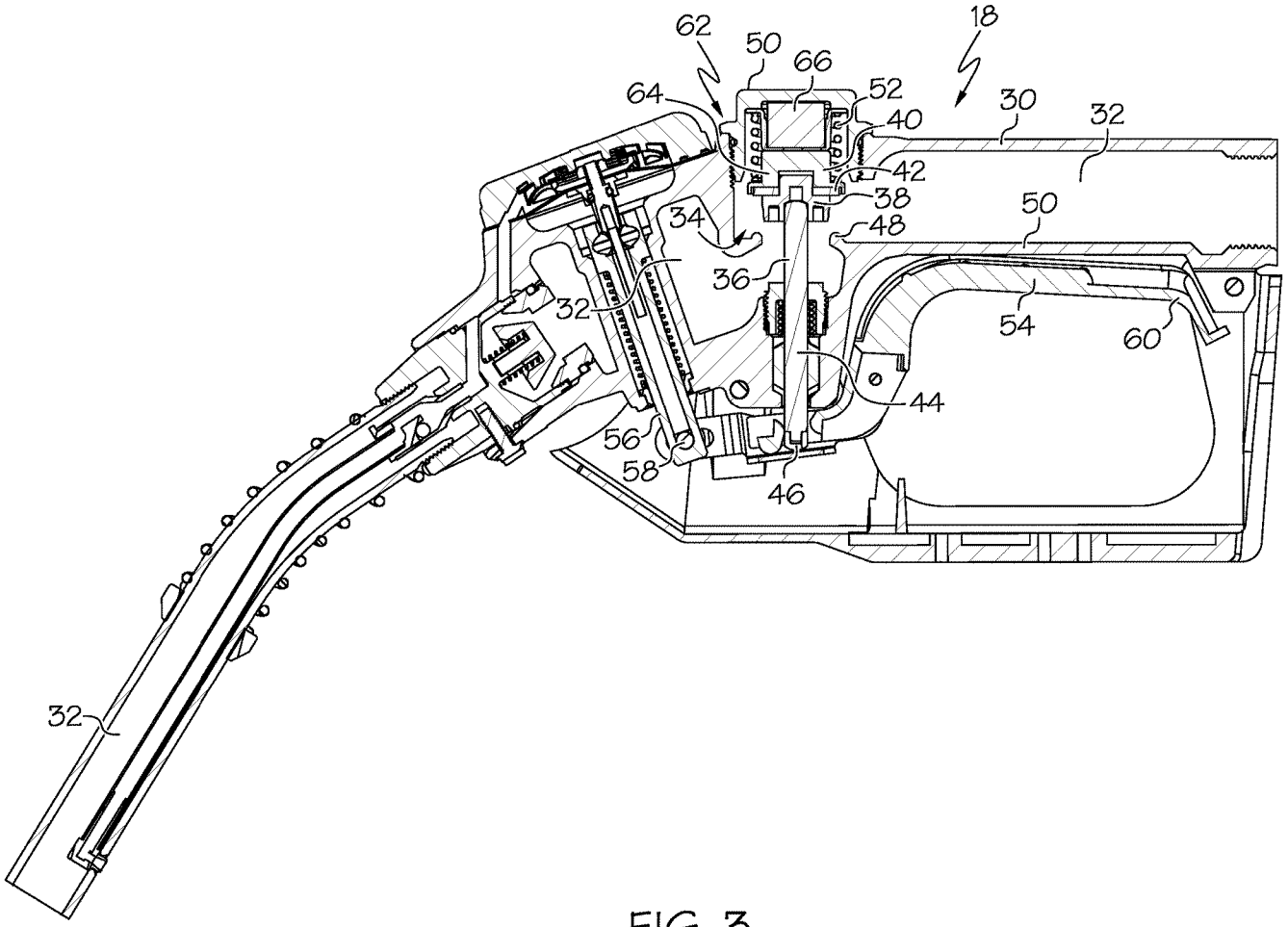
FIG. 3 illustrates the nozzle of FIG. 2 in its dispensing configuration.
Figure 6:
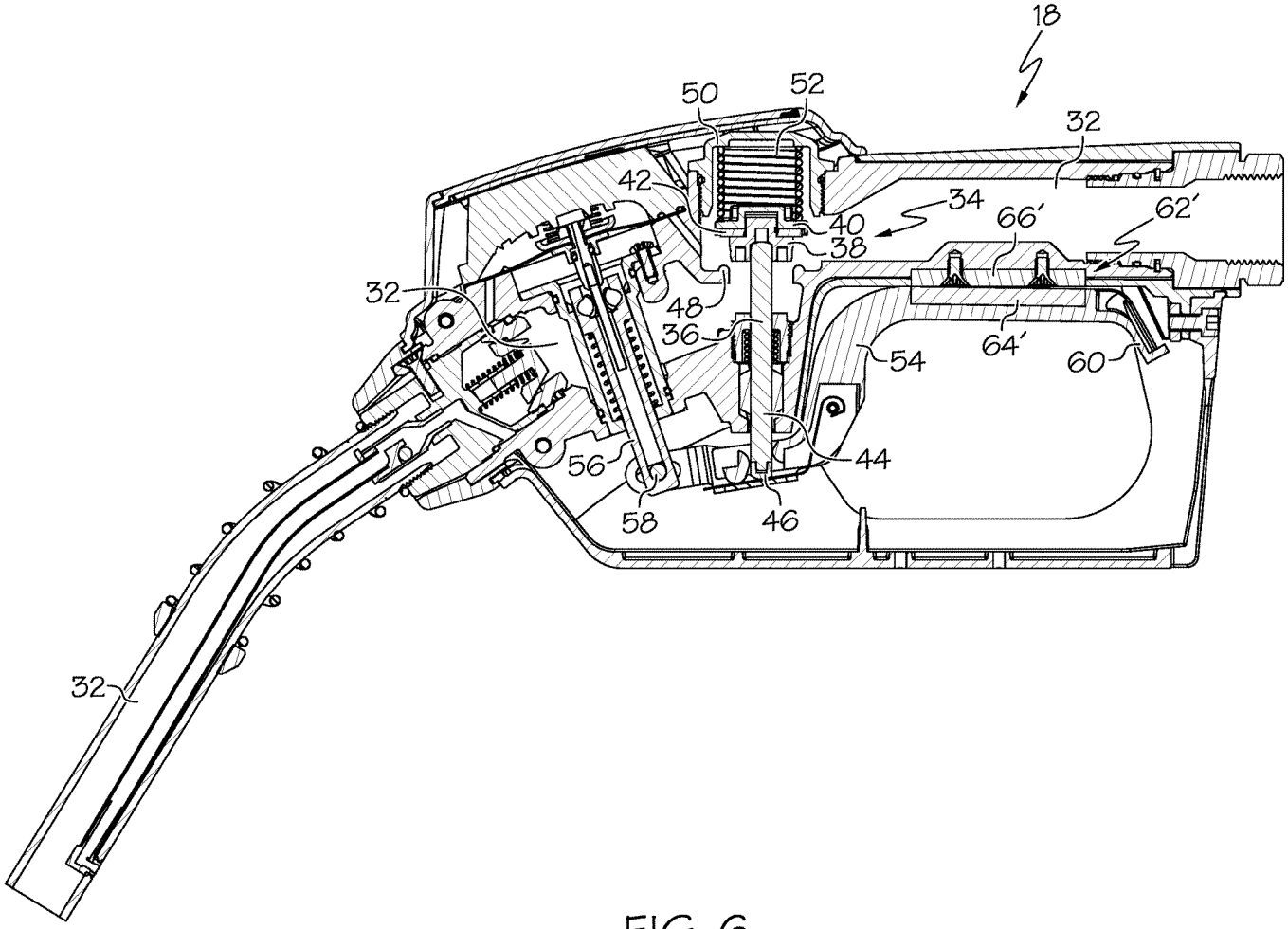
FIG. 6 illustrates the nozzle of FIG. 5 in its dispensing configuration.

The nozzle body 30 can includes a threaded cap 50 positioned above the valve 34. The valve 34 can include a valve spring 52 positioned between the movable portion 36 of the valve 34 and the threaded cap 50. When the valve 34 is in its closed position, the valve spring 52 can be at least relatively slightly compressed to press the valve 34 into sealing engagement with the seat 48. When the valve 34 is open, as shown in FIGS. 3 and 6, the valve spring 52 is compressed or more compressed compared to when the valve 34 is in its closed position. The valve spring 52 thus biases or urges the valve 34 to its closed position.

The nozzle 18 can include a handle or lever 54 that is operatively coupled or operatively couplable to the valve 34 to thereby control and/or block/allow the flow of fluid through the nozzle 18/fluid path 32/valve 34. The lever 54 can be coupled to or positioned adjacent to a latch pin 56 that, in some cases (e.g. when conditions are appropriate for fluid dispensing), is fixed in place and not movable along its axis, and in other cases (e.g. when conditions are not appropriate for fluid dispensing) is displaceable/movable along its axis from the position shown in FIG. 2. When the latch pin 56 is locked in place, the latch pin 56 thereby provides a pivot point 58 about which the lever 54 is pivotable.

Thus when conditions are appropriate the lever 54 is manually movable about the pivot point 58 between a first, lower, closed or non-operating position (FIGS. 2 and 5) in which the lower end of the stem 44 protrudes a relatively long distance from the nozzle body 30 and the valve 34 is closed, and a second, upper, open or operating position (FIGS. 3 and 6) in which lever 54 is raised and the stem 44 is moved by the lever 54 axially upwardly such that the lower end 46 of the stem 44 protrudes (if at all) a lesser distance from the nozzle body 30. When the stem 44 is raised, the flange 42 is moved away from the seat 48, the spring 52 is more compressed and the valve 34 is opened. Thus movement of the lever 54 from its lower to its upper position further compresses the spring 52, and such movement of the lever 54 is resisted by the spring 52.

The lever 54 thus has a range of motion defined by the first position at one end of the range of motion and the second position at the other end of the range of motion. In the illustrated embodiments, when the lever 54 is in its lower position the lever 54 is positioned such that a distal end 60 of the lever 54 is spaced away from the nozzle body 30, or at least those portions of the nozzle body 30 through which fluid flows. Conversely, in the illustrated embodiments when the lever 54 is in its upper position the lever 54 is positioned such that the distal end 60 is positioned adjacent the nozzle body 30, or at least those portions through which fluid flows.

It is noted that the spring 52 biases the valve 34 to its closed position, which can in turn bias the lever 54 to its lower/closed position. Thus the spring 52 can be considered to also bias the lever 54 to its lower position, although the spring 52 in the illustrated embodiment indirectly biases the lever 54 to its lower position. However, other spring/biasing arrangements for the lever 54 can be utilized, such as directly spring biasing the lever 54 instead of, or in addition to, spring biasing the valve 34, in which case the valve stem 44 may be positively coupled to the lever 54.

Figure 2:
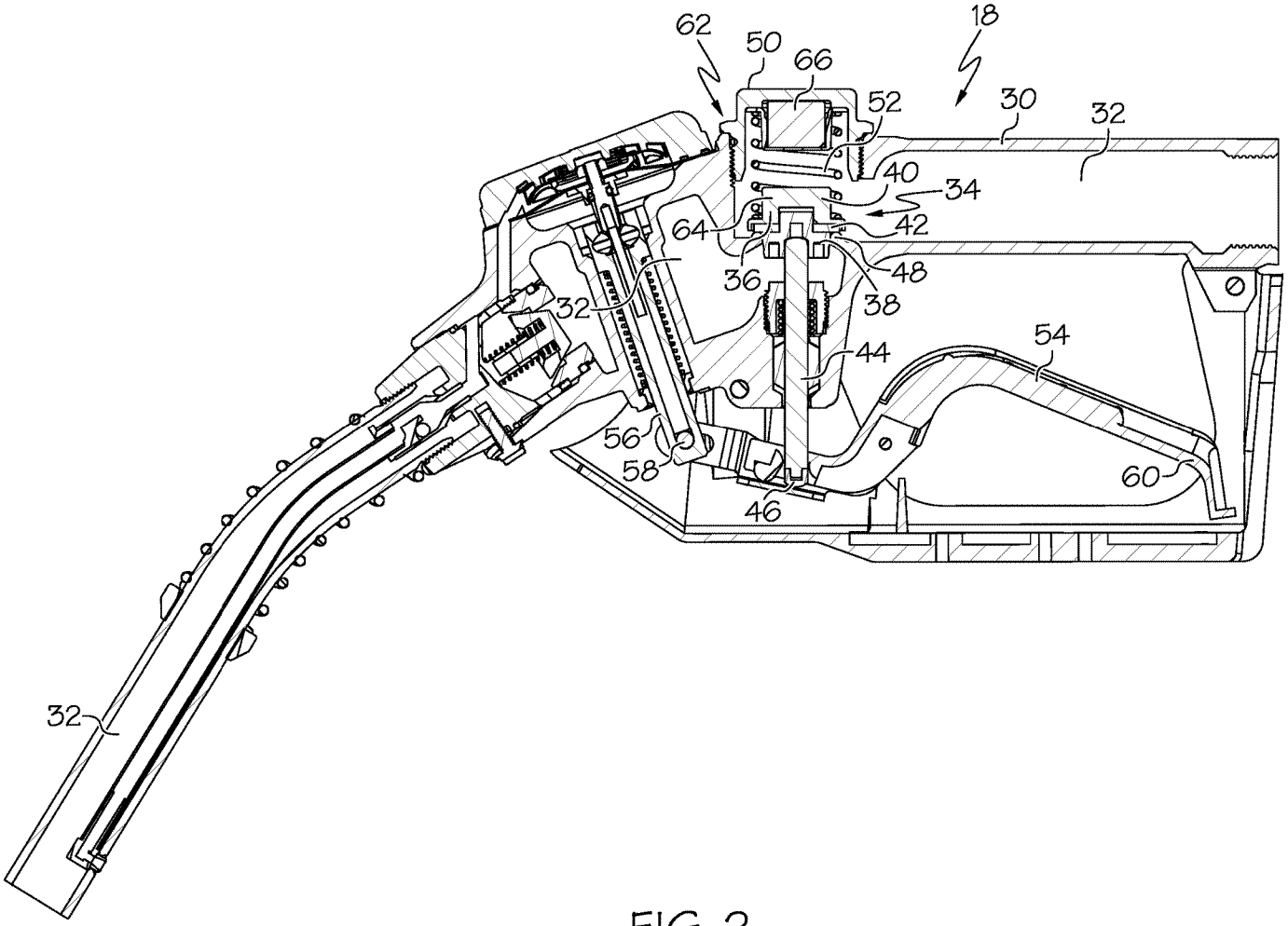
FIG. 2 is a side cross section of one embodiment of a nozzle, shown in its non-dispensing configuration.

The nozzle 18 can include a magnetic assist feature or system, generally designated 62, to reduce the force required by a user to maintain the lever 54/nozzle 18 in its dispensing configuration. In a first embodiment as shown in FIGS. 2 and 3, the magnetic assist system 62 includes a first magnetic component 64 coupled to or forming part of the valve 34, and a second magnetic component 66 coupled to or forming part of the nozzle body 30. In the illustrated embodiment the first magnetic component 64 includes or is coupled the movable portion 36 of the valve 34, and more particularly comprises the upper portion 40 of the valve 34. The second magnetic component 66 of the magnetic assist system 62 can be coupled to the cap 50 and positioned inside the spring 52, both radially and/or axially, to provide a space savings and easily fit into many existing systems. However, the first 64 and second 66 components can be positioned on differing portions of the valve 34 and/or nozzle body 30 as desired.

The first 64 and second 66 components can be magnetically attracted to each other. For example, both of the components 64, 66 can be made of magnets, including permanently magnetized material (such as rare earth magnets or ferromagnetic material) and/or electromagnets. In this case the first 64 and second 66 components may be oriented with a polarity such that the first 64 and second 66 magnets are attracted to each other. Alternatively, only one of the first 64 or second 66 components may be made of a magnet, and the other one of the first 64 or second 66 components can be made of a magnetizable material (e.g. ferrous metal or other materials that are magnetically attracted to magnets). If desired one or both of the components 64, 66 can be plated, coated or encapsulated (e.g. with zinc or nickel in one case) to protect those components from the fluid to be dispensed, or from air, humidity or other environmental factors.

The magnetic assist system 62 and components 64, 66 can apply attractive force in a direction causing the lever 54 to be moved to its second position (e.g. be raised) and/or valve 34 to be open, and opposing the force applied by the spring 52. The magnetic assist system 62 can apply a force in a direction opposite to the force applied by the spring 52, even when the lever 54 is in its lower position and the valve 34 is closed, as shown in FIG. 2. In this case, when the valve 34 is closed, the components 64, 66 have a maximum relative spacing across the range of motion of the valve 34/lever 54, and applied magnetic forces are at their minimum. As the lever 54 is raised and the valve 34 is opened, the distance between the components 64, 66 decreases, and the attractive magnetic forces increase. When the lever 54 is fully raised and the valve 34 is fully opened, the distance between the components 64,66 is minimized, as shown in FIG. 3, and the applied magnetic forces are at their maximum across the range of motion for the valve 34/lever 54.

Thus the magnetic assist system 62 applies a force in a direction opposite to spring force reducing the forces required to open and hold open the valve 34, providing ease of operation to the user. In addition, the magnetic assist force is at its highest levels when the spring force is also at its highest, thus providing greatest assistance where most needed. In addition, the magnetic force is minimized and relatively low when the valve 34 is closed, such that the magnetic assist system 62 does not interfere with closing/sealing of the valve 34, and a relatively high-force spring 52 can be used.

Figure 4:
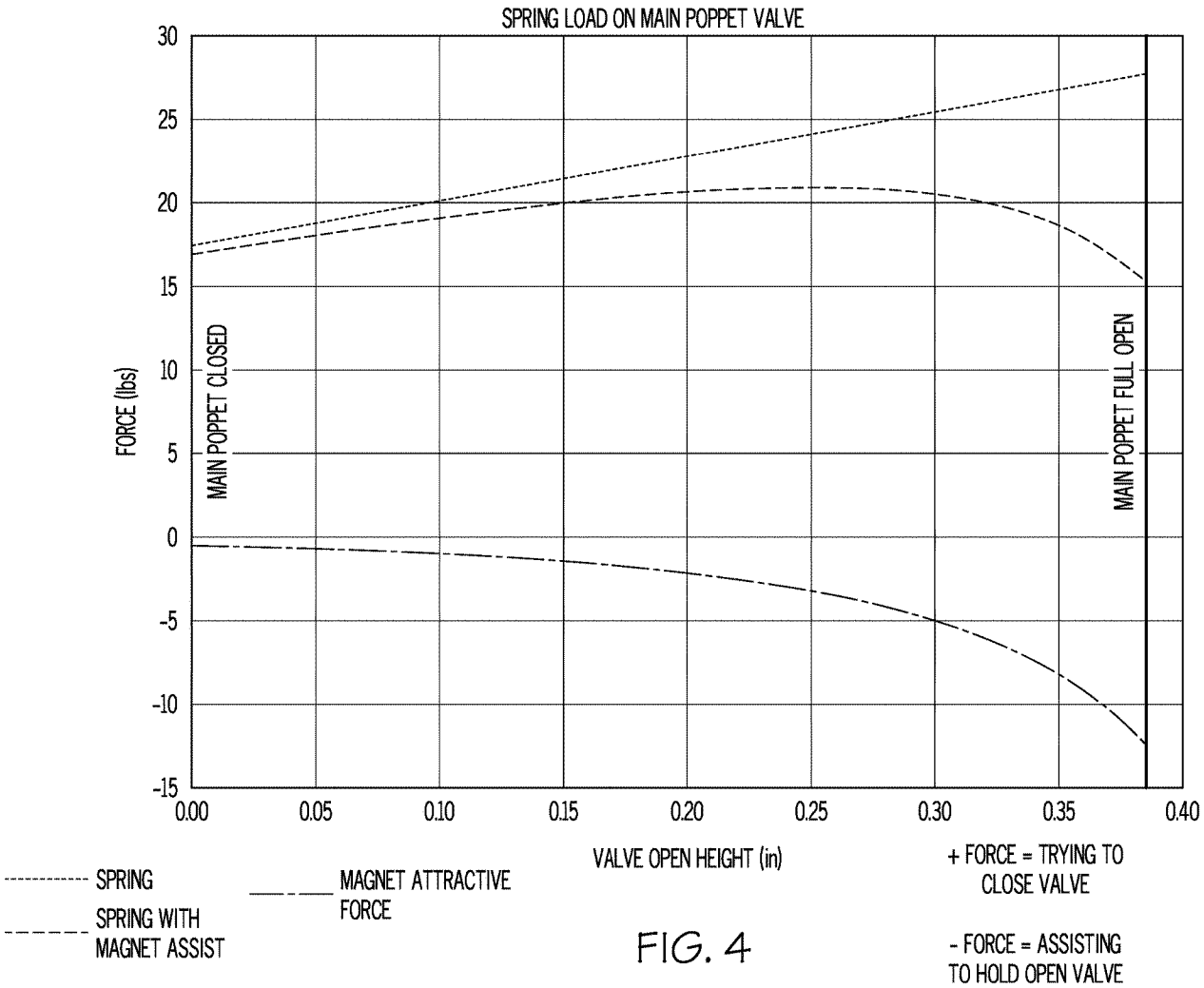
FIG. 4 is a graph illustrating spring force and magnetic force, as a function of the position of the fluid valve, for one embodiment of a nozzle.

The force applied by the spring 52 typically varies linearly with respect to position of the valve 34/lever 54, while the force applied by the magnetic assist system 62 is inversely proportional to the square of the position of the valve 34/lever 54. FIG. 4 illustrates one particular example of the applied forces with respect to distance (i.e. "Valve Open Height"). The values and characteristics shown in FIG. 4 are solely for illustrative purposes in one particular instance, and the magnetic assist force is represented by a negative value, and the spring force represented by a positive value. Moreover the graph of FIG. 4 does not take into account other possible forces, such as liquid pressure acting on the valve 34 when the valve 34 is closed.

The net force applied to the valve 34 (indicated by the line labelled "Spring with magnet assist") can be calculated by adding together the spring force (considered a positive value in the example herein) and the magnetic force (considered a negative value in the example herein). With reference to FIG. 4, when the valve 34 is closed (i.e. has a Valve 34 Open Height along the x axis of 0.00) the net force is relatively close to the spring force. However, as the valve 34 approaches its fully open position (i.e. has a Valve Open Height of about 0.38 inches in FIG. 4) the magnetic assist force increases in magnitude faster than the spring force.

In the illustrated embodiment, then, the magnetic assist system is configured such that the attractive force applied to the valve 34/lever 54 is lowest (in magnitude), across the range of motion of the valve 34/lever 54, when the valve 34 and lever 54 are in their lower positions, as shown in FIG. 2. Conversely the magnetic assist system 62 is configured such that the attractive forces applied to the valve 34/lever 54 is highest (in magnitude), across the range of motion of the valve 34/lever 54, when the valve 34 and lever 54 are in their upper positions, as shown in FIG. 3. In addition, in one case the net force is lowest in magnitude, across the ranges of motion, when the valve 34 and lever 54 are in their upper positions. However, this can vary depending upon the attractive magnetic forces and the strength of the spring 52, as well as other forces present in the operation of the nozzle 18, which can provide variability as to where, in the range of travel of the lever 54, the lowest net force occurs. For example, the spring force, magnetic force and associated components can be configured such that the lowest net force is applied when the valve 34/lever 54 are in their lower positions, and the net force when the valve 34/lever 54 are in their upper positions is equal to or slightly exceeds the net force when the valve 34/lever 54 are in their lower positions. In all cases, however, it may be desired to ensure the magnetic assist system reduces the net force required to hold open the lever 54/valve 34 when the lever 54 is fully raised and/or the valve 34 is fully opened, compared to when the magnetic assist system 62 is not utilized. As can be seen in FIG. 4, the exemplary magnetic assist system reduces the force required to hold open the valve 34 from about 28 lbs. to about 15.5 lbs.

Moreover, when in the first position and/or second positions, and indeed for the entire range of motion, the spring force may be greater than the magnetic forces. This can help to ensure the valve 34/lever 54 are always biased to the lower positions and do not get "stuck" in their upper positions. In addition, as can be seen the net force curve has a maximum value which is surpassed when a user fully opens the lever 54/valve 34, and a relatively rapid drop-off. This "hump" or local maximum and/or drop-off in the net force curve or profile provides a tactile feedback to the user so that user can be assured the maximum dispensing rate is being applied and/or to aid in fine metering dispensing since the "hump" provides a tactile frame of reference. However, the net force curve may not necessarily have such a hump or local maximum.

Figure 5:
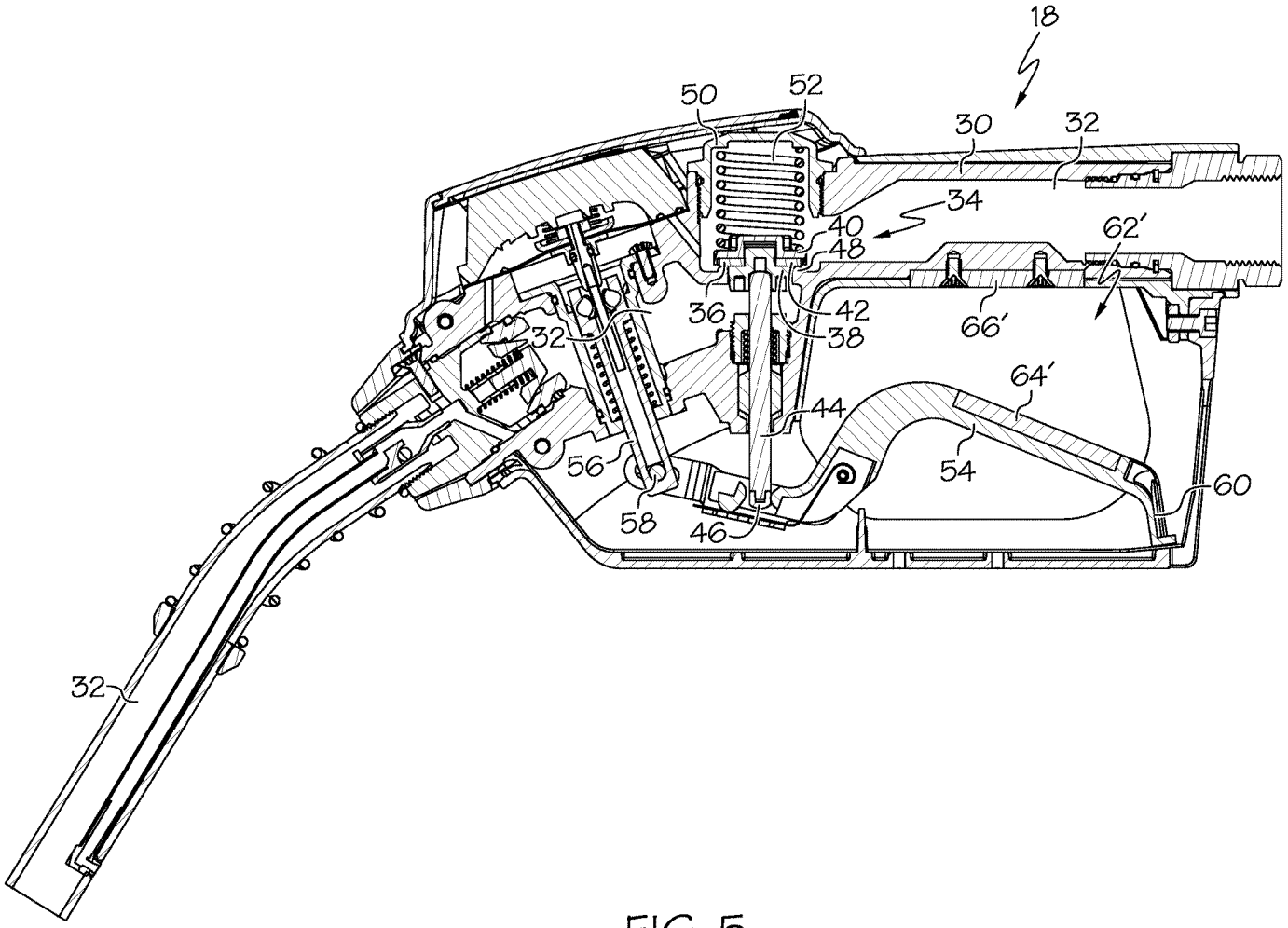
FIG. 5 is a side cross section of another embodiment of a nozzle, shown in its non-dispensing configuration.

The magnetic assist system 62 can also include or take the form of the system 62' shown in FIGS. 5 and 6. In this case the first magnetic component 64' is coupled to or forms part of the lever 54, and the second magnetic component 66' is coupled to or forms part of the nozzle body 30 positioned adjacent to the lever 54. In the illustrated embodiment the first component 64' is located on an upper surface of a distal end of the lever 54, and the second component 66' is located on an underside of the fluid path 32 at a distal end of the nozzle body 30. However, the first 64' and second 66' components can be located at a variety of positions beyond those specifically shown in FIGS. 5 and 6.

When the lever 54 is in its lower position, as shown in FIG. 5, the components 64', 66' are spaced apart at a maximum distance along the range of motion of the lever 54. In contrast, when the lever 54 is in its upper position, as shown in FIG. 6, the components 64', 66' are positioned relatively close together, and spaced apart, if at all, a minimum distance along the range of motion of the lever 54. In the illustrated embodiment, the first 64' and second 66' components are positioned immediately adjacent to each other, or even in contact with each other, when the lever 54 is in its upper position. However, the first 64' and second 66' components may still remain spaced apart in some cases when the lever 54 is in its upper position.

The embodiment shown in FIGS. 5 and 6 may operate on similar principles and with similar characteristics as the embodiment shown in FIGS. 2 and 3 and discussed above. In addition, the embodiment of FIGS. 5 and 6 can have a force/distance plot similar or comparable to that of FIG. 4, providing the same or similar characteristics or benefits. However, the components 64', 66' embodiment of FIGS. 5 and 6 may experience greater relative travel and therefore may have somewhat differing operating characteristics. For example, the magnetic assist system 62' of FIGS. 5 and 6 may require a lower magnetic force since the additional lever arm distance provided by the lever 54 provides a mechanical advantage. In addition, in the embodiment of FIGS. 5 and 6 the components 64', 66' are fluidly isolated from the fluid path 32 and therefore may be better positioned to resist corrosion. If desired the embodiment of FIGS. 2 and 3 may be used in conjunction with the embodiment of FIGS. 5 and 6.

Thus, it can be seen that the magnetic assist features/systems 62, 62' disclosed herein provide an assistive force to enable ease of opening the valve 34 and/or operating the lever 54. The magnetic assist systems 62, 62' can be implemented in existing nozzles without requiring modification, as the magnetic components can be positioned on or in existing components for most nozzles. The magnetic assist systems 62, 62' can ease user fatigue in operation of the nozzle 18, and can accommodate and/or eliminate need for a hold-open system. In addition the systems 62, 62' are easily implemented and robust.

Having described the invention in detail and by reference to the various embodiments, it should be understood that modifications and variations thereof are possible without departing from the scope of the claims of the present application.

What is claimed is:

1. A nozzle system comprising:

a nozzle body having a fluid path through which fluid to be dispensed is flowable, the nozzle body having a distal end that is manually insertable into the fill pipe of a vehicle;

a fluid valve positioned in said fluid path and movable between a closed position and an open position;

a manually operable lever operatively coupleable to said fluid valve and movable between a lower position and an upper position; and a magnetic assist system configured to apply a force tending to directly or indirectly move said valve to its open position, wherein the magnetic assist system is configured to apply a magnetic force directly to the fluid valve, or wherein the magnetic assist system is configured to apply a magnetic force directly to the lever to thereby tend to move the lever to its upper position.

2. The system of claim 1 further comprising a biasing mechanism configured to bias the valve to the closed position, and wherein said force of said magnetic assist system tending to move said valve to its open position opposes said force applicable by said biasing mechanism.

3. The system of claim 2 wherein the biasing mechanism is configured to directly bias the valve to the closed position, which in turn biases the lever to the lower position.

4. The system of claim 2 wherein said force of said magnetic assist system tending to move said valve to said open position is less than a force applied by said biasing mechanism.

5. The system of claim 1 wherein the entire nozzle system is manually movable to insert said distal end into said fill pipe.

6. A nozzle system comprising:

a nozzle body having a fluid path through which fluid to be dispensed is flowable, the nozzle body having a distal end that is manually insertable into the fill pipe of a vehicle;

a fluid valve positioned in said fluid path and movable between a closed position and an open position;

a manually operable lever operatively coupleable to said fluid valve and movable between a lower position and an upper position; and a magnetic assist system configured to apply a force tending to directly or indirectly move said valve to its open position, wherein the magnetic assist system is configured to apply a magnetic force to the lever which tends to move the valve to its open position when the lever is operatively coupled to the valve.

7. A method for operating a nozzle comprising:

accessing a nozzle including a nozzle body having a fluid path through which fluid to be dispensed is flowable, a fluid valve positioned in said fluid path and movable between a first position and a second position, a manually operable lever movable between a first position and a second position, a biasing mechanism configured to apply a force to bias at least one of said valve or said lever to one of the associated first or second positions, and a magnetic assist system;

inserting a distal end of said nozzle into the fill pipe of a vehicle; and manually operating said lever to move, against said force applied by said biasing mechanism, said lever from its first position to its second position which thereby causes said valve to move from its first position to its second position, and wherein said magnetic assist system applies a magnetic force opposing said force applied by said biasing mechanism during said operating step.

8. A nozzle system comprising:

a nozzle body having a fluid path through which fluid to be dispensed is flowable, the nozzle body having a distal end that is manually insertable into the fill pipe of a vehicle;

a fluid valve positioned in said fluid path and movable between a first position and a second position;

a manually operable lever operatively coupleable to said fluid valve and movable between a first position and a second position;

a biasing mechanism configured to apply a force biasing at least one of said valve or said lever to one of the associated first or second positions; and a magnetic assist system configured to apply a magnetic force opposing said biasing force applied by said biasing mechanism.

9. The nozzle system of claim 8 wherein the lever is directly mechanically coupleable to the fluid valve.

10. The nozzle system of claim 8 wherein the lever is directly mechanically coupled to the fluid valve.

11. The nozzle system of claim 1 wherein the lever is directly mechanically coupleable to the fluid valve.

12. A nozzle system comprising:

a nozzle body having a fluid path through which fluid to be dispensed is flowable, the nozzle body having a distal end that is manually insertable into the fill pipe of a vehicle;

a fluid valve positioned in said fluid path and movable between a closed position and an open position;

a manually operable lever operatively coupleable to said fluid valve and movable between a lower position and an upper position;

a magnetic assist system configured to apply a force tending to directly or indirectly move said valve to its open position; and a biasing mechanism configured to apply a force to the valve to maintain the valve in its closed position when the valve is in its closed position, and wherein the magnetic assist system is configured to apply a magnetic force opposing said biasing force applied by said biasing mechanism.

* * * * *